US008966833B2

(12) United States Patent
Ally

(10) Patent No.: US 8,966,833 B2
(45) Date of Patent: Mar. 3, 2015

(54) CONCRETE INSERT

(76) Inventor: Mohamed R. Ally, Woodbridge (CA)

( * ) Notice: Subject to any disclaimer, the term of this patent is extended or adjusted under 35 U.S.C. 154(b) by 0 days.

(21) Appl. No.: 13/612,672

(22) Filed: Sep. 12, 2012

(65) Prior Publication Data

US 2014/0069048 A1 Mar. 13, 2014

(51) Int. Cl.

| | |
|---|---|
| ***E04B 1/41*** | (2006.01) |
| ***E04C 5/12*** | (2006.01) |
| *E04B 1/35* | (2006.01) |

(52) U.S. Cl.

CPC ..... *E04B 1/41* (2013.01); *E04B 1/3511* (2013.01); *E04B 1/35* (2013.01)

USPC ..... 52/125.4; 52/125.5; 52/125.1; 52/122.1; 52/708

(58) Field of Classification Search

CPC ..... E04B 1/3511; E04B 1/35; E04B 1/41; E04C 5/12; E04C 5/16; E04C 5/18

USPC ..... 52/125.4, 125.5, 125.2, 125.1, 122.1, 52/127.3, 708, 710, 711

See application file for complete search history.

(56) References Cited

U.S. PATENT DOCUMENTS

| | | | | | |
|---|---|---|---|---|---|
| 774,441 | A | | 11/1904 | Luck | |
| 1,136,460 | A | | 4/1915 | Wright | |
| 1,241,827 | A | | 10/1917 | Davis | |
| 1,409,524 | A | | 3/1922 | Chase | |
| 1,491,571 | A | * | 4/1924 | Tomkinson et al. | 52/708 |
| 1,768,246 | A | | 6/1930 | Gaddis | |
| 1,922,479 | A | | 8/1933 | Joslin | |
| 1,929,835 | A | * | 10/1933 | Awbrey | 52/709 |
| 2,133,134 | A | * | 10/1938 | Davis | 52/708 |
| 2,181,740 | A | | 11/1939 | Reiland | |
| 2,280,080 | A | * | 4/1942 | Predan | 52/99 |
| 3,095,672 | A | * | 7/1963 | Di Tullio et al. | 52/710 |
| 3,157,966 | A | | 11/1964 | Sherburne | |
| 3,449,883 | A | * | 6/1969 | Juten et al. | 52/710 |
| 3,896,597 | A | | 7/1975 | Deason | |
| 4,130,977 | A | | 12/1978 | Taylor, Jr. et al. | |
| 4,445,303 | A | | 5/1984 | Judkins | |

(Continued)

FOREIGN PATENT DOCUMENTS

| | | | |
|---|---|---|---|
| AU | 150474 | S | 1/2003 |
| AU | 151532 | S | 4/2003 |

(Continued)

OTHER PUBLICATIONS

Tolco, Fig. 109AF—Concrete Insert, Dec. 20, 2007, 1 page.

(Continued)

*Primary Examiner* — Phi A

(57) ABSTRACT

A concrete insert for casting in a concrete wall panel, having a housing having an elongate center portion and two opposing longitudinal sides, and two opposing longitudinal flanges. The elongate center portion is bounded by opposing outer longitudinal bend lines, the elongate center portion defining a longitudinally oriented nut access slot. The opposing longitudinal sides depend inwardly from the opposing outer longitudinal bend lines to opposing inner longitudinal bend lines. The opposing longitudinal flanges depend from opposing inner longitudinal bend lines transversely to the opposing longitudinal sides and extend in mutually divergent relation. The housing and the nut box insert comprise a nut box. The nut box insert comprises at least one resilient layer having resilient end walls compressed against the housing by the compression plate for substantially preventing wet cement from entering the nut box. In another approach, end walls substantially prevent wet cement from entering the nut box.

25 Claims, 15 Drawing Sheets

(56) References Cited

U.S. PATENT DOCUMENTS

| | | | | |
|---|---|---|---|---|
| 4,831,796 | A * | 5/1989 | Ladduwahetty | 52/125.5 |
| 4,905,444 | A * | 3/1990 | Semaan et al. | 52/710 |
| 5,625,993 | A * | 5/1997 | Kelly | 52/704 |
| 5,809,703 | A * | 9/1998 | Kelly | 52/125.5 |
| D406,524 | S | 3/1999 | Steenson et al. | |
| 5,890,340 | A | 4/1999 | Kafarowski | |
| 7,237,368 | B2 | 7/2007 | Richardson et al. | |
| D572,569 | S | 7/2008 | Magnesio et al. | |
| 2003/0217521 | A1 | 11/2003 | Richardson et al. | |

FOREIGN PATENT DOCUMENTS

| | | |
|---|---|---|
| CA | 2070623 | 12/1993 |
| CA | 2213850 | 2/1998 |
| GB | 399581 A | 10/1933 |

OTHER PUBLICATIONS

LB&A Inc., Linn Brown and Associates, Loop Design Light Duty Concrete Insert for Pipe Hanger, Feb. 9, 2009, 2 pages.

Dayton Superior, Miscellaneous Connection Inserts, Jul. 2007, 4 pages.

JVI Inc., PSA Slotted Inserts for precast concrete panel connections, 8 pages, Aug. 2000.

Waters & McDonald Associates, Nut type Inserts for precast concrete wall panels, Feb. 9, 2009, 2 pages.

UNISTRUT—Concrete Inserts, 10 pages.

* cited by examiner

CONCRETE INSERT

FIELD OF THE INVENTION

This invention relates to an improved concrete insert for attaching concrete panels to buildings.

BACKGROUND OF THE INVENTION

Current building practices in North America and elsewhere utilize pre-cast concrete wall panels to form the perimeter walls of a building. A plurality of concrete inserts are embedded in the concrete panels when they are pre-cast, such that a substantially flat elongate center portion of each concrete insert is located flush with the intended inside surface of the pre-cast concrete wall panels. An access slot through the elongate center portion of each concrete insert provides access for an attaching bolt to connect with a captive nut, located in an enclosed concrete free channel under the elongate center portion, the enclosed channel commonly referred to as a "nut box". The nut is selectively positioned under the access slot to receive the inserted attaching bolt. An attaching bolt is typically first inserted through an aperture in a structural member of the building and then secured to the captive nut in the nut box of the concrete insert pre-cast in the concrete wall panel, thus securing the pre-cast concrete wall panel to the structural member of the building, to form the perimeter walls of the building.

Concrete inserts typically have a metal, housing formed from a single sheet of plate steel, being bent into an inverted "U" shaped or "V" shaped channel with an open bottom and open ends. The elongate center portion forms the valley of the inverted "U" or "V" shaped channel and opposing longitudinal sides depending from the elongate center portion form the sides of the inverted "U" or "V" shaped channel. The inverted "U" or "V" shaped channel of the nut box only allows the nut to be displaced longitudinally under the open slot in the nut box, and prevents the nut from rotating when an attaching bolt is threaded into the nut. Typically the nut is biased against the bottom of the elongate center portion by a spring compressed between the nut and the bottom wall of a not box insert which covers the open bottom and open sides of the housing, the nut box insert and the housing together forming the not box for keeping wet concrete out of the nut box during the forming process. Although it is been attempted to construct a nut box insert for sealing the bottom and ends of the housing solely with Styrofoam™ foam and dispensing with the spring, due to its lower cost and simplicity, this arrangement does not exert sufficient pressure against the nut to keep it in a preselected position while the concrete panel is attached to a building. Further, such foam is nut box inserts may be deformed or displaced during the forming process potentially allowing wet concrete into the nut box and preventing the nut from, traveling along the nut box under the slot in the elongate center portion thus preventing adjustability of the concrete insert.

Accordingly, there exists a need for a concrete insert with a foam nut box insert which sufficiently biases the nut under the nut access slot against the elongate center portion of the concrete insert and resists deformation or displacement during the concrete panel forming process.

SUMMARY

The invention provides a concrete insert for casting in a concrete wall panel, the concrete wall panel having an inside surface for attachment to a building, the concrete insert comprising, a housing having an elongate center portion and two opposing longitudinal sides, and two opposing longitudinal flanges. The elongate center portion is bounded by opposing outer longitudinal bend lines and having an outer attachment surface for mounting the elongate center portion substantially flush with the inside surface of the concrete wall panel, the elongate center portion defining a longitudinally oriented nut access slot. The opposing longitudinal sides depend inwardly from the opposing outer longitudinal bend lines to opposing inner longitudinal bend lines. The opposing longitudinal flanges depend from opposing inner longitudinal bend lines transversely to the opposing longitudinal sides and extend in mutually divergent relation. The housing and the nut box insert comprise a nut box. A nut defines a threaded aperture. The nut is slidably mounted in the nut box. The housing constrains rotation of the nut for the threaded aperture in the nut to receive a threaded fastener through the nut access slot for attaching the concrete wall panel to the building. The nut box insert comprises at least one resilient layer carried by a compression plate, the compression plate attached to the housing. The compression plate is for compressing the at least one resilient layer against the bottom of the nut for permitting the nut to be slidably located within the nut box and for holding the nut under pressure in a selected location in the nut box for the threaded aperture in the nut to receive the threaded fastener through the nut access slot while the nut is in the selected location.

In one aspect the resilient layer comprises resilient end walls compressed against the housing by the compression plate for substantially preventing wet cement from, entering the nut box during casting of the concrete panel.

In another aspect the compression plate comprises end walls for substantially preventing wet cement from entering the nut box during casting of the concrete panel.

BRIEF DESCRIPTION OF THE DRAWINGS

Certain embodiments of the invention are illustrated with reference to the accompanying drawings, by way of example only and without limiting other embodiments of the invention that would be understood by those skilled in the art, wherein.

DETAILED DESCRIPTION OF EXEMPLARY EMBODIMENTS OF THE INVENTION

Certain exemplary embodiments of the invention are described below with reference to the accompanying drawings. Orientation references relate to the concrete insert as it would be cast in a concrete wall panel, and the wall panel being vertically attached to a building, it being understood that the concrete insert could be used in other orientations. In particular the term outer shall refer to elements closer to the intended mounting surface of the pre-cast concrete wall panels, and the term inner shall refer to elements further away from the intended mounting surface of the pre-cast concrete wall panels (that is inner elements being deeper in the concrete of the concrete panels from the mounting surface of the panels). The terms outwardly and inwardly have corresponding meanings The terms inside and outside do not have corresponding meanings to the terms inner and outer, and the terms inside and outside shall have appropriate meanings as the context permits or requires.

Figure 1:
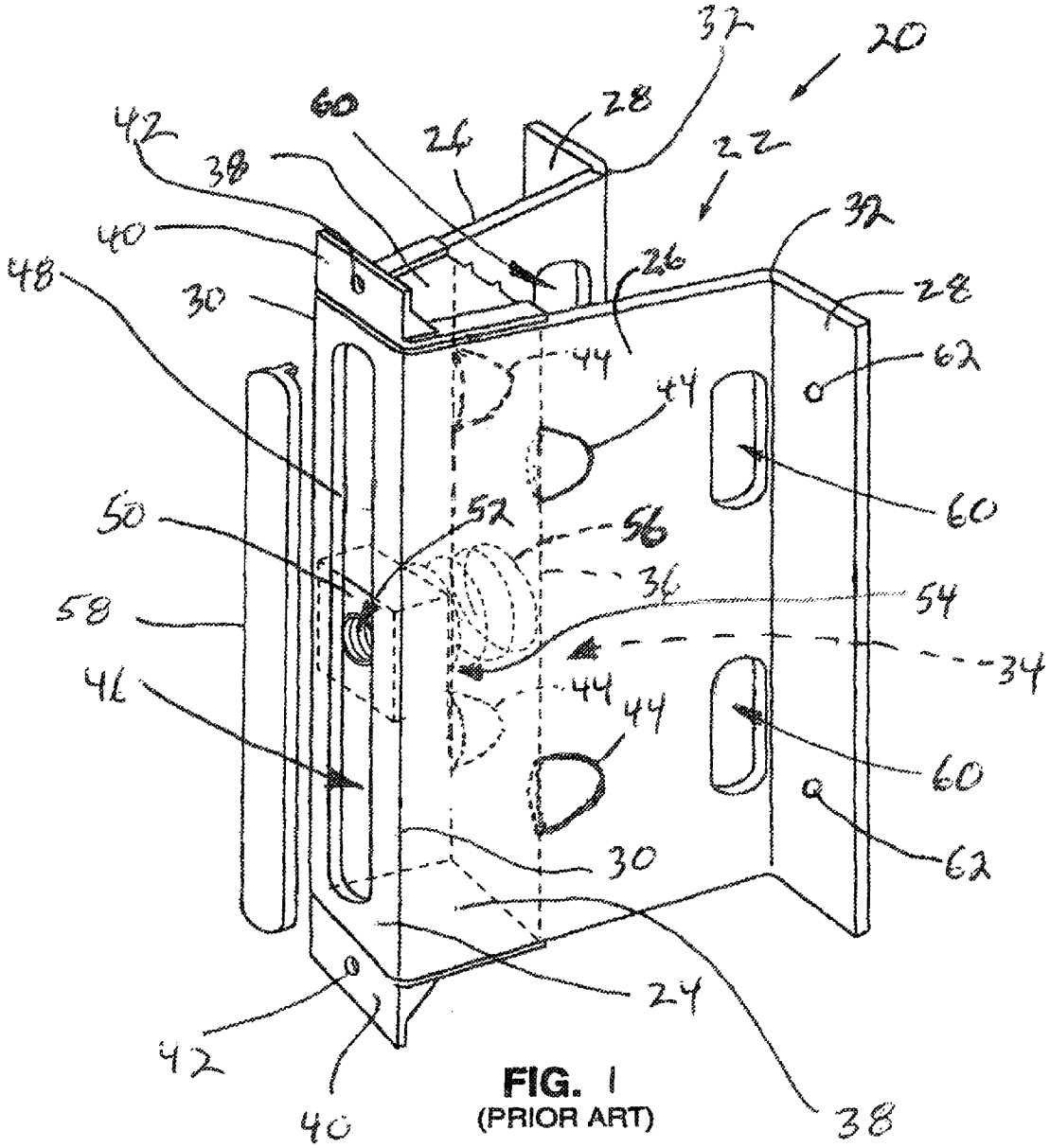
FIG. 1 (PRIOR ART)
FIG. 1 is a perspective view of a prior art concrete insert.

The improvements herein to the prior art are best understood by reference to FIG. 1 showing a prior art concrete insert 20. Prior art concrete insert 20 comprises a housing 22 having an elongate center portion 24 and longitudinal sides 26 depending from outer longitudinal bend lines 30 and extending to inner longitudinal bend lines 32. Longitudinal flanges 28 depend from inner longitudinal bend lines 32 transverse to longitudinal sides 26 and extend in mutually divergent relation. Longitudinal flanges may have stud apertures 62. Longitudinal sides 26 have rebar apertures 60. Elongate center portion 24 has nut access slot 48 with nut access slot cap 58 (not shown in FIGS. 2-15 for clarity). Nut access slot cap 58 covers nut access slot 48 when the concrete insert is attached to the form in which concrete panels are cast and left in nut access slot 48 until the concrete hardens and the form is removed. Nut access slot cap 58 may then be removed anytime prior to mounting of the concrete panel (not shown) to the building (not shown). Prior art concrete insert 20 has a prior art plastic nut box insert 34 defining a concrete free nut box 46 or channel. Nut 50 with threaded aperture 52 comprises recessed seat 54 which carries biasing spring 56 which together travel along nut box 46. FIG. 1 shows a typical metal prior art housing 22 with open bottom and open ends covered by prior art plastic nut box insert 34. Prior art nut box insert 34 has bottom 36 supported by punched nut box insert supports 44 and has plastic nut box insert end 38 to prevent wet concrete from entering the nut box, and opposing plastic nut box insert flanges 40 at each end of the housing 22. Plastic nut box insert flanges 40 have mounting apertures 42 for attaching the concrete insert 20 to a concrete form (not shown) typically by nailing concrete insert 20 to the concrete form through mounting apertures 42.

With respect to the following embodiments of the invention, it is to be understood that the inventive concrete insert would usually be sold with an access slot cover 58 installed therein, however access slot covers may be sold separately, and installed as required. Such access slot covers 58 could also be reusable. Alternatively, the user may supply their own means for sealing nut access slot (128, 228, 328, 428) before forming, such as by the application of a strip of duct tape over the elongate center portion (104, 204, 304, 404). However, preferably a plastic access slot cover 58 is mounted in nut access slot (128, 228, 328, 428) during manufacture, such as by a friction fit, for removal after forming.

Figure 2:
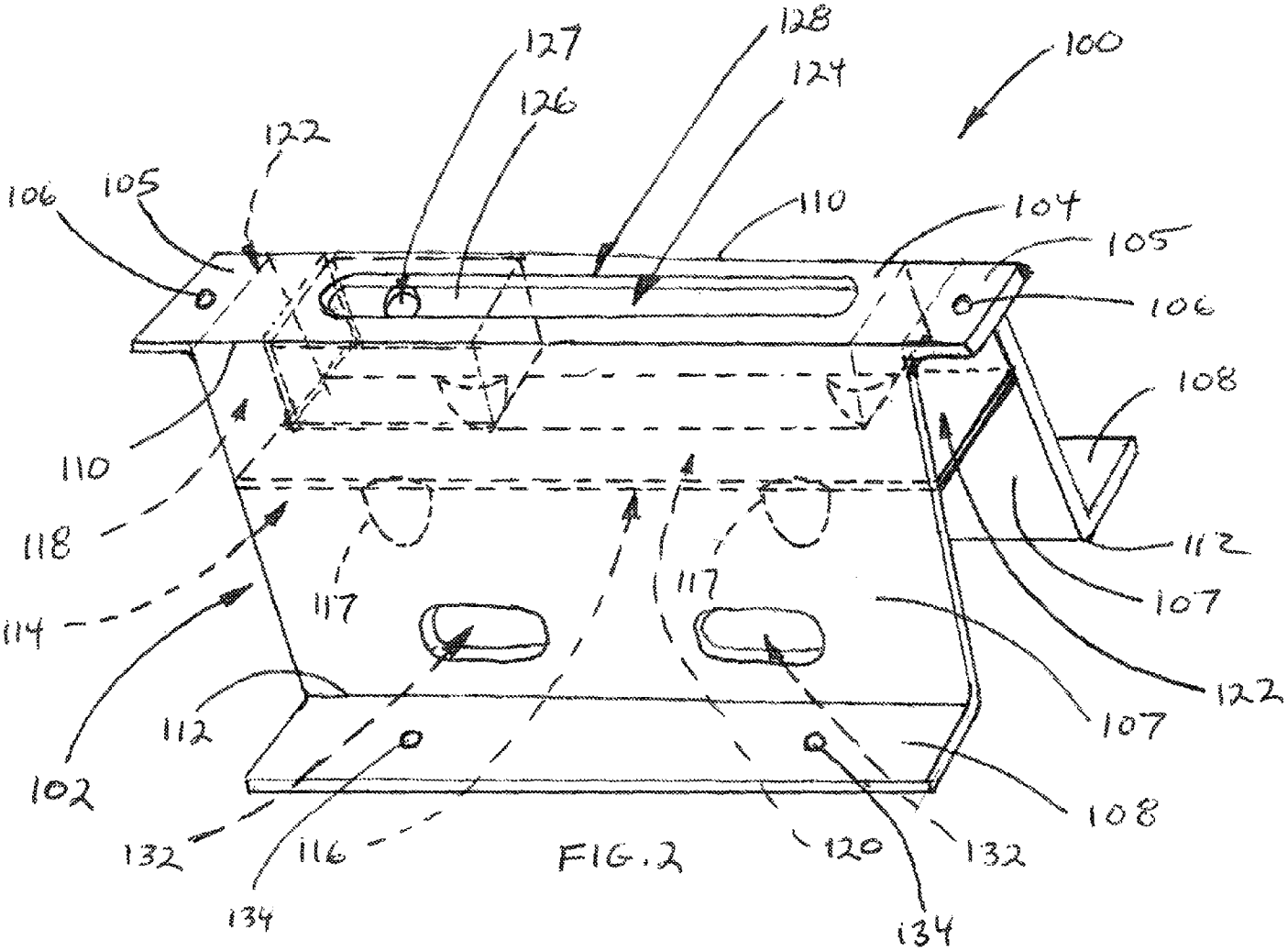
FIG. 2 is a perspective view of a first embodiment of the concrete insert.

FIG. 2 is a perspective view of a first embodiment of a concrete insert, namely, concrete insert 100. Concrete insert 100 has a housing 102 comprising a substantially flat elongate center portion 104, having an outer attachment surface which is usually substantially flush with the mounting surface of the concrete wall panel in which concrete insert 100 is to be used. Housing 102 also has mounting flanges 105 each comprising mounting flange aperture 106, for mounting concrete insert 100 to a form. Mounting flanges 105 extend longitudinally from each end of elongate center portion 104, preferably, but not necessarily co-planer with elongate center portion 104.

Elongate center portion 104 is longitudinally bounded by substantially parallel outer longitudinal bend lines 110 and has a longitudinally oriented nut access slot 128 therebetween for the insertion of a threaded fastener, usually a bolt or threaded rod (not shown). Opposing longitudinal sides 107 (of Housing 102) depend inwardly from outer longitudinal bend lines 110 (preferably in mutually divergent relation, although opposing longitudinal sides 107 may be parallel to each other for example), to inner longitudinal bend lines 112 (preferably parallel to outer longitudinal bend lines 110), and terminate at transverse opposing longitudinal flanges 108 depending from inner longitudinal bend lines 112 and extending in mutually divergent relation (preferably parallel to elongate center portion 104). Opposing longitudinal sides 107 are delineated from longitudinal flanges 108 by inner longitudinal bend lines 112. Longitudinal flanges 108 may be provided with stud apertures 134.

Compression plate 116 is attached between longitudinal sides 107 by compression plate supports 117 or other conventional means such as riveting, bolting, welding or the like, which compression plate 116 carries on its inside surface a compression pad 118. Compression plate 116 and compression pad 118 together form nut box insert 114, located above rebar apertures 132. Compression pad 118 need not necessarily be made of foam rubber but can be made of any resilient layer or layers capable of biasing nut 126 against the inside surface of elongate center portion 104 for selectively locating and maintaining the threaded aperture 127 of nut 126 in a preselected position under nut access slot 128 for receiving a bolt, threaded rod or other threaded fastener, for attaching the concrete wall panel to a building, typically through an aperture in a fixed position in a structural member of a building, typically a steel girder.

A nut 126 is slideably mounted in nut box 124 on bottom portion 120 of compression pad 118, which in turn is carried by compression plate 116. The preferably square nut 126 is supported in sliding frictional engagement along the inside surface of bottom portion 120 of compression pad 118 and the inside surface of elongate center portion 104. Compression pad 118 has enlarged end portions 122 for preventing entry of wet cement into the nut box 124 during casting of concrete panels. End portions 122 are compressed by compression plate 116 against opposing sides 107 and elongate center portion 104 between nut access slot 128 and mounting flanges 105 to prevent wet concrete from entering the nut box during concrete panel forming. Compression pad end portions 122 may also be sized to ensure that threaded aperture 127 of nut 126 is always under nut access slot 128. Nut 126 is readily longitudinally repositioned in nut box 124 by finger or other pressure. It is to be understood that preferably square nut 126 need not be square but may be in any shape to operably engage the inside surfaces of longitudinal sides 107 to constrain the nut 126 from turning in nut box 124 upon receiving a threaded fastener through nut access slot 128.

Compression pad 118 may comprise one or more portions or sections, with each section or portion comprising one or more layers. For example bottom portion 120 and end portions 122, of compression pad 118 may be separate pieces, although it is preferable for bottom portion 120 and end portions 122 to be unitary. Alternatively, compression pad 118 may comprise layers of different materials, either separate or unitary. Bottom portion should be sufficiently resilient to hold nut 126 firmly in place while receiving a threaded fastener while still not making the positioning of nut 126 by hand difficult or impossible. Alternatively if strong positioning strength is required tools may be required to position nut 126. Further end portions 122 may be sized or contoured to best mate with the inside walls of longitudinal sides 107 and elongate center portion 104, when sufficiently compress to prevent the seepage of wet concrete into nut box 124. Porous foam is preferably not used even if significantly compressed due to the possibility of leaking. Foam rubber has been found to be particularly advantageous due to compression properties, both for biasing nut 126 and compressing end portions 122, as well as being substantially non-porous.

Figure 3:
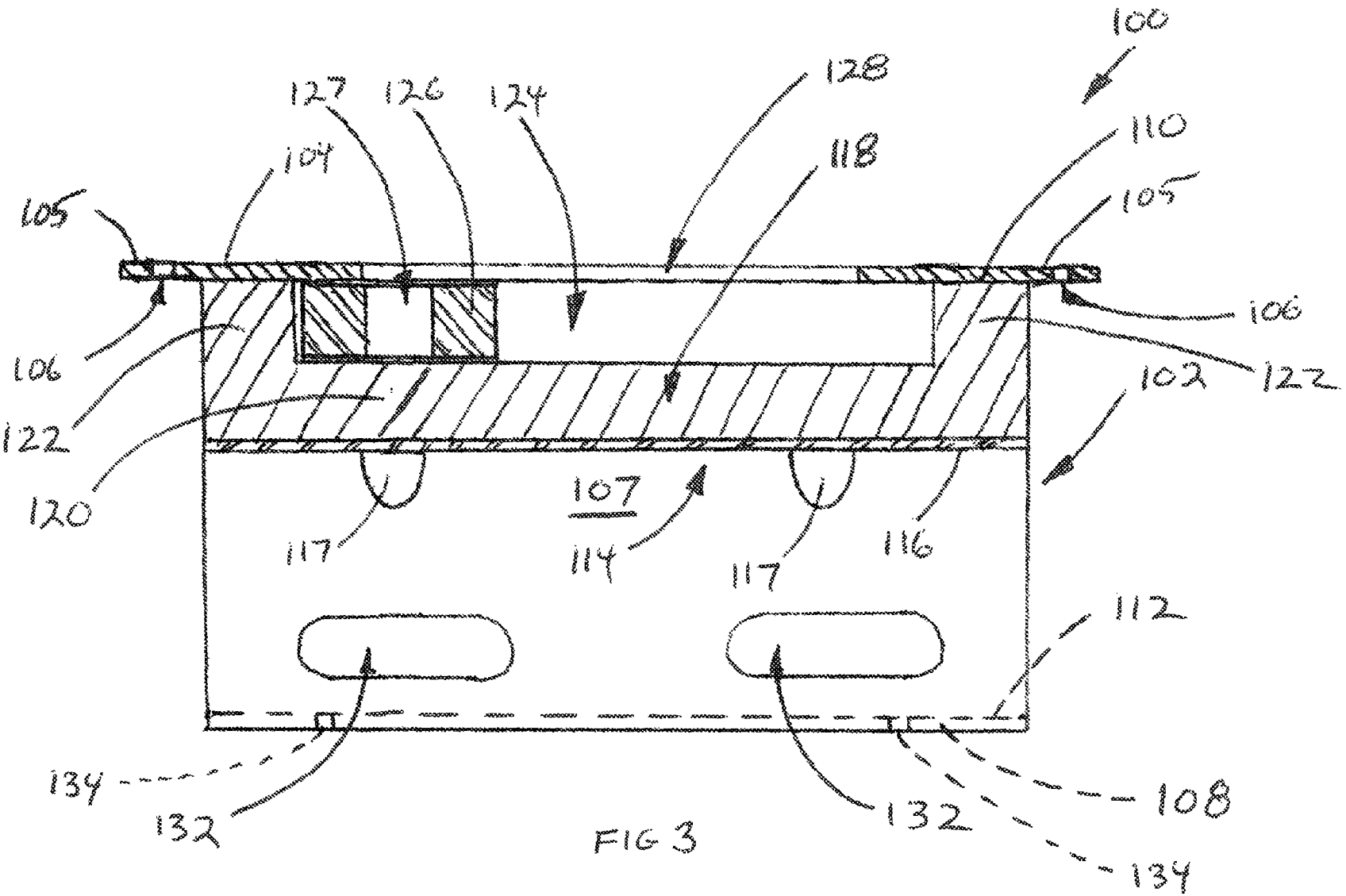
FIG. 3 is a sectional side view of the first embodiment of the concrete insert taken along line 3-3 of FIG. 4.
Figure 4:
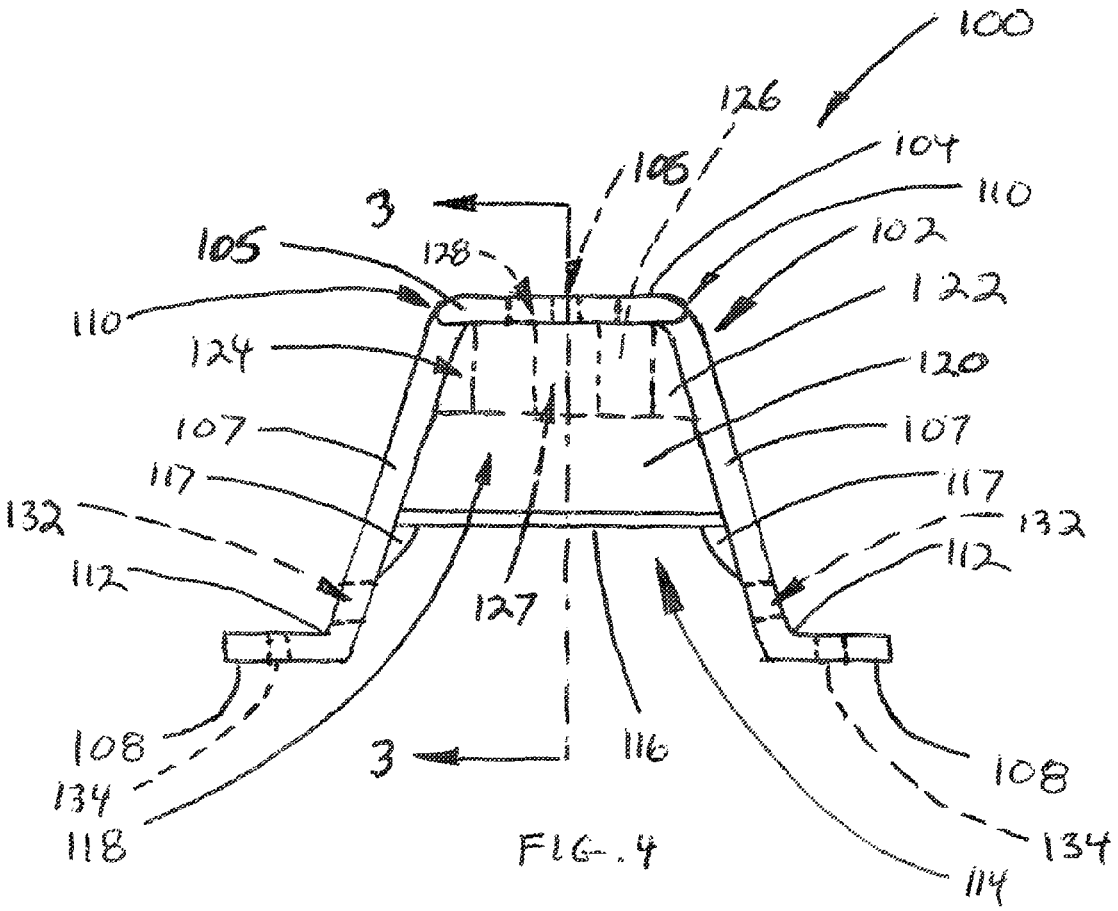
FIG. 4 is an end view of the first embodiment of the concrete insert.
Figure 5:
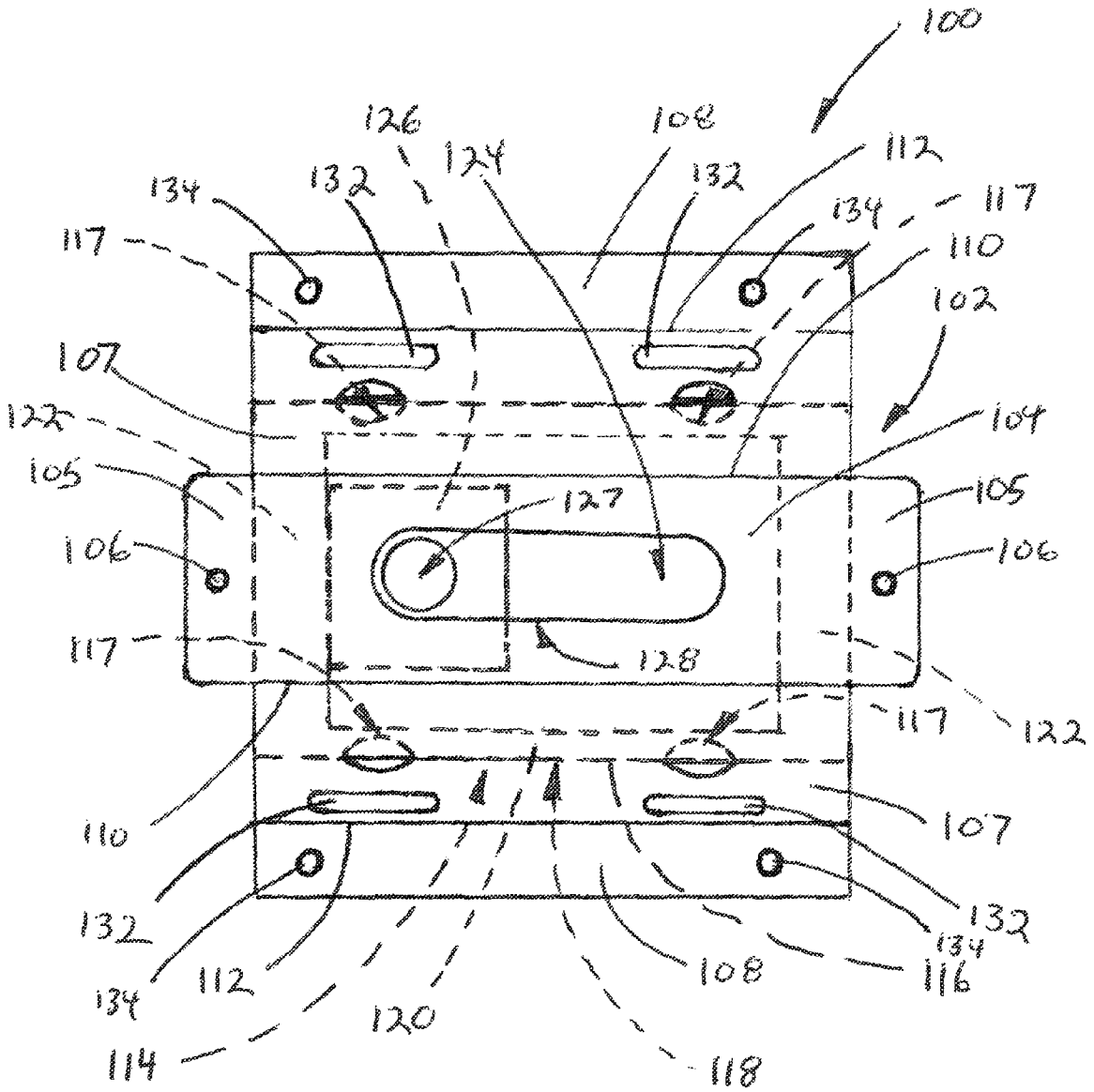
FIG. 5 is a top view of the first embodiment of the concrete insert.
Figure 6:
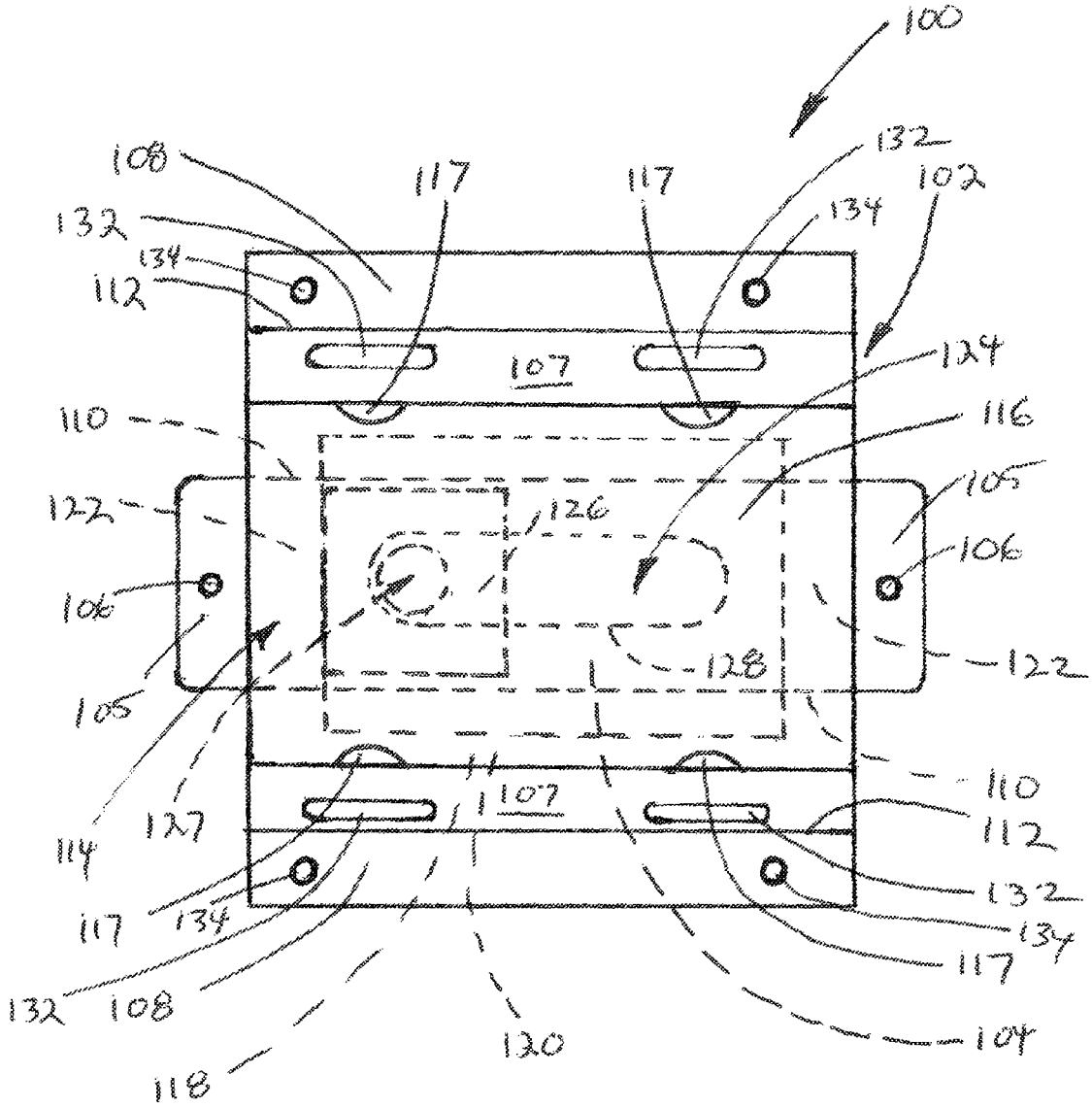
FIG. 6 is a bottom view of the first embodiment of the concrete insert.

FIG. 3 is a sectional side view of concrete insert 100 taken along line 3-3 of FIG. 4, and shows the same features as in FIG. 2. FIG. 4 is an end view of concrete insert 100 and shows the same features as in FIG. 2. FIG. 5 is a top plan view of concrete insert 100 and shows the same features as in FIG. 2. FIG. 6 is a bottom plan view of concrete insert 100 and shows the same features as in FIG. 2.

Figure 7:
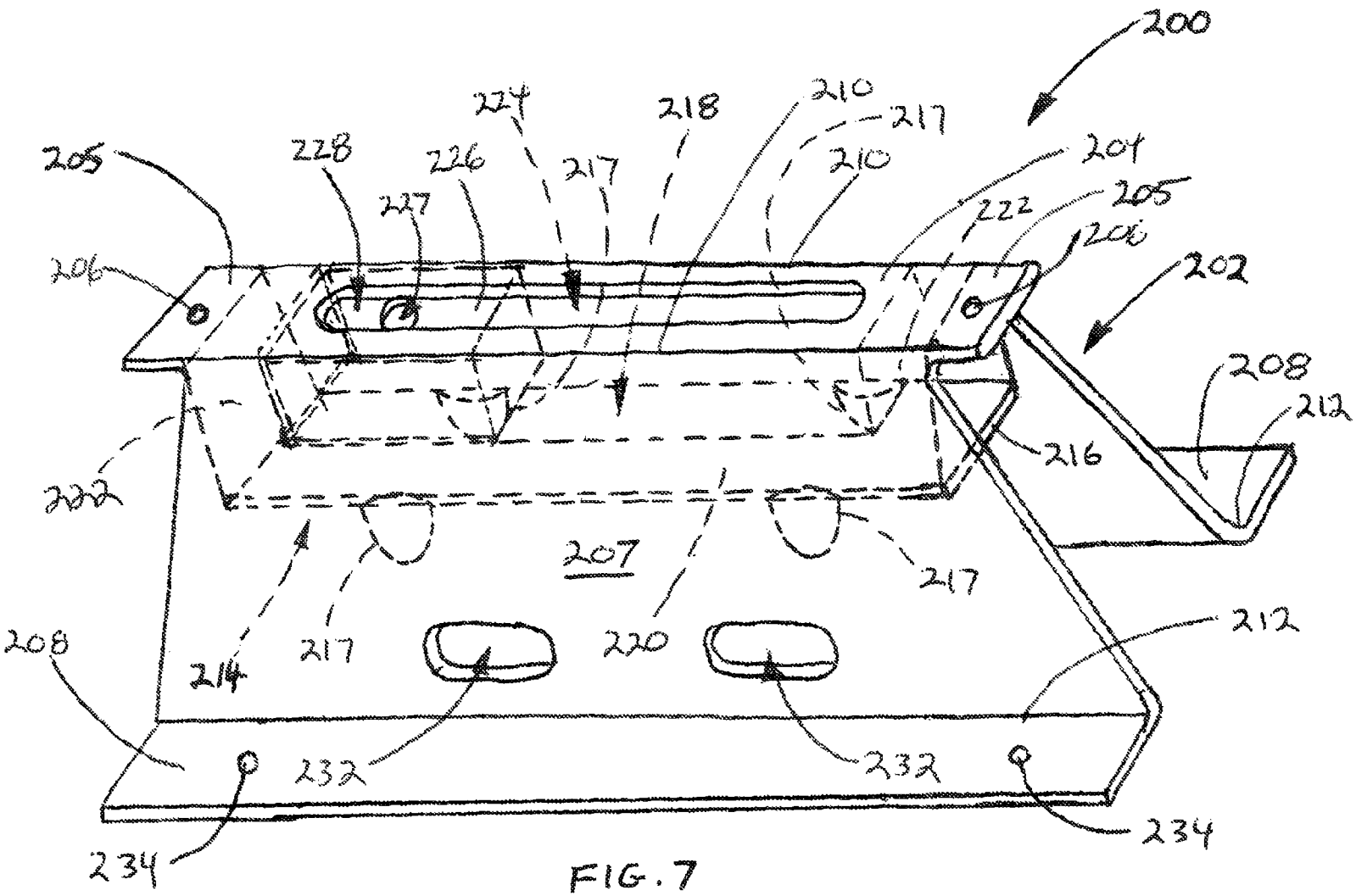
FIG. 7 is a perspective view of a second embodiment of the concrete insert.

FIG. 7 is a perspective view of a second embodiment of the concrete insert, namely, concrete insert 200. Concrete insert 200 is identical to concrete insert 100 except that concrete insert 200 shows the ends of longitudinal sides 207 extending inwardly from the ends of elongate center portion 204 in mutually divergent relation. Accordingly, compression plate 216 and end portions 222 of compression pad 218 need not extend longitudinally past the perpendicular extensions of the ends of elongate center portion 204 so that mounting flange apertures 206 of mounting flanges 205 are not blocked by compression plate 216 or end portions 222 of compression pad 218.

Concrete insert 200 has a housing 202 comprising a substantially flat elongate center portion 204, having an outer attachment surface which is usually substantially flush with the mounting surface of the concrete wall panel in which concrete insert 200 is to be used. Housing 202 also has mounting flanges 205 each comprising mounting flange aperture 206, for mounting concrete insert 200 to a form. Mounting flanges 205 extend longitudinally from each end of elongate center portion 204, preferably, but not necessarily co-planer with elongate center portion 204.

Elongate center portion 204 is longitudinally bounded by substantially parallel outer longitudinal bend lines 210 and has a longitudinally oriented nut access slot 228 therebetween for the insertion of a threaded fastener, usually a bolt or threaded rod (not shown). Opposing longitudinal sides 207 (of Housing 202) depend inwardly from outer longitudinal bend lines 210 (preferably in mutually divergent relation, although opposing longitudinal sides 207 may be parallel to each other for example), to inner longitudinal bend lines 212 (preferably parallel to outer longitudinal bend lines 210), and terminate at transverse opposing longitudinal flanges 208 depending from inner longitudinal bend lines 212 and extending in mutually divergent relation (preferably parallel to elongate center portion 204). Opposing longitudinal sides 207 are delineated from longitudinal flanges 208 by inner longitudinal bend lines 212. Longitudinal flanges 208 may be provided with stud apertures 234.

Compression plate 216 is attached between longitudinal sides 207 by compression plate supports 217 or other conventional means such as riveting, bolting, welding or the like, which compression plate 216 carries on its inside surface a compression pad 218. Compression plate 216 and compression pad 218 together form nut box insert 214, located above rebar apertures 232. Compression pad 218 need not necessarily be made of foam rubber but can be made of any resilient layer or layers capable of biasing nut 226 against the inside surface of elongate center portion 204 for selectively locating and maintaining the threaded aperture 227 of nut 226 in a preselected position under nut access slot 228 for receiving a bolt, threaded rod or other threaded fastener, for attaching the concrete wall panel to a building, typically through an aperture in a fixed position in a structural member of a building, typically a steel girder.

A nut 226 is slideably mounted in nut box 224 on bottom portion 220 of compression pad 218, which in turn is carried by compression plate 216. The preferably square nut 226 is supported in sliding frictional engagement along the inside surface of bottom portion 220 of compression pad 218 and the inside surface of elongate center portion 204. Compression pad 218 has enlarged end portions 222 for preventing entry of wet cement into the nut box 224 during casting of concrete panels. Compression pad end portions 222 may also be sized to ensure that threaded aperture 227 of nut 226 is always under nut access slot 228. Nut 226 is readily longitudinally repositioned in nut box 224 by finger or other pressure. It is to be understood that preferably square nut 226 need not be square but may be in any shape to operably engage the inside surfaces of longitudinal sides 207 to constrain the nut 226 from turning in nut box 224 upon receiving a threaded fastener through nut access slot 228.

Compression pad 218 may comprise one or more portions or sections with each section or portion comprising one or more layers. For example bottom portion 220 and end portions 222, of compression pad 218 may be separate pieces, although it is preferable for bottom portion 220 and end portions 222 to be unitary. Alternatively, compression pad 218 may comprise layers of different materials, either separate or unitary. Bottom portion should be sufficiently resilient to hold nut 226 firmly in place while receiving a threaded fastener while still not making the positioning of nut 226 by hand difficult or impossible. Alternatively if strong positioning strength is required tools may be required to position nut 226. Further end portions 222 may be sized or contoured to best mate with the inside walls of longitudinal sides 207 and elongate center portion 204, when sufficiently compressed to prevent the seepage of wet concrete into nut box 224. Porous foam is preferably not used even if significantly compressed due to the possibility of leaking. Foam rubber has been found to be particularly advantageous due to compression properties, both for biasing nut 226 and compressing end portions 222, as well as being substantially non-porous.

Figure 8:
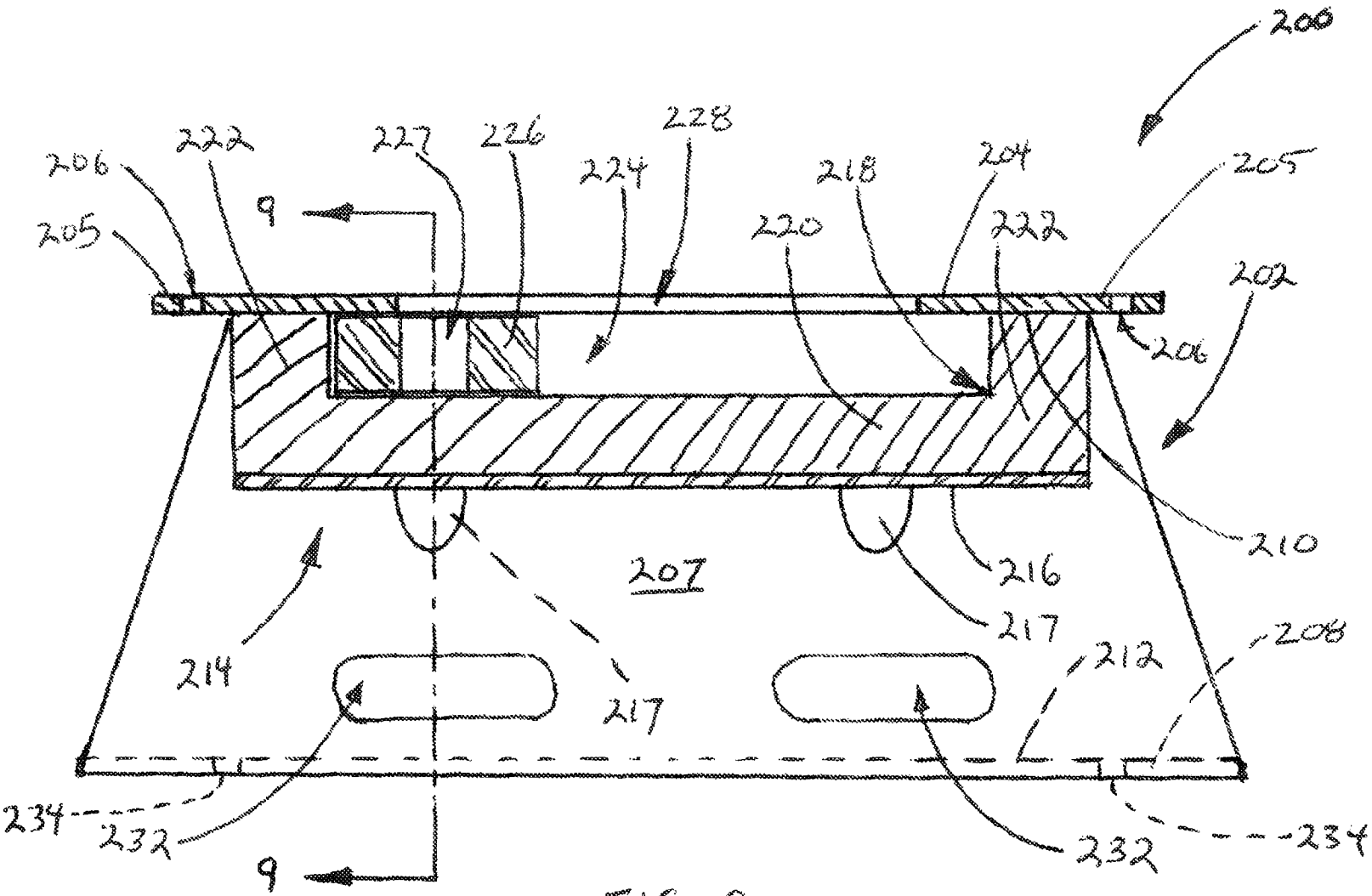
FIG. 8 is a sectional side view of the second embodiment of the concrete insert taken along line 8-8 of FIG. 9.
Figure 9:
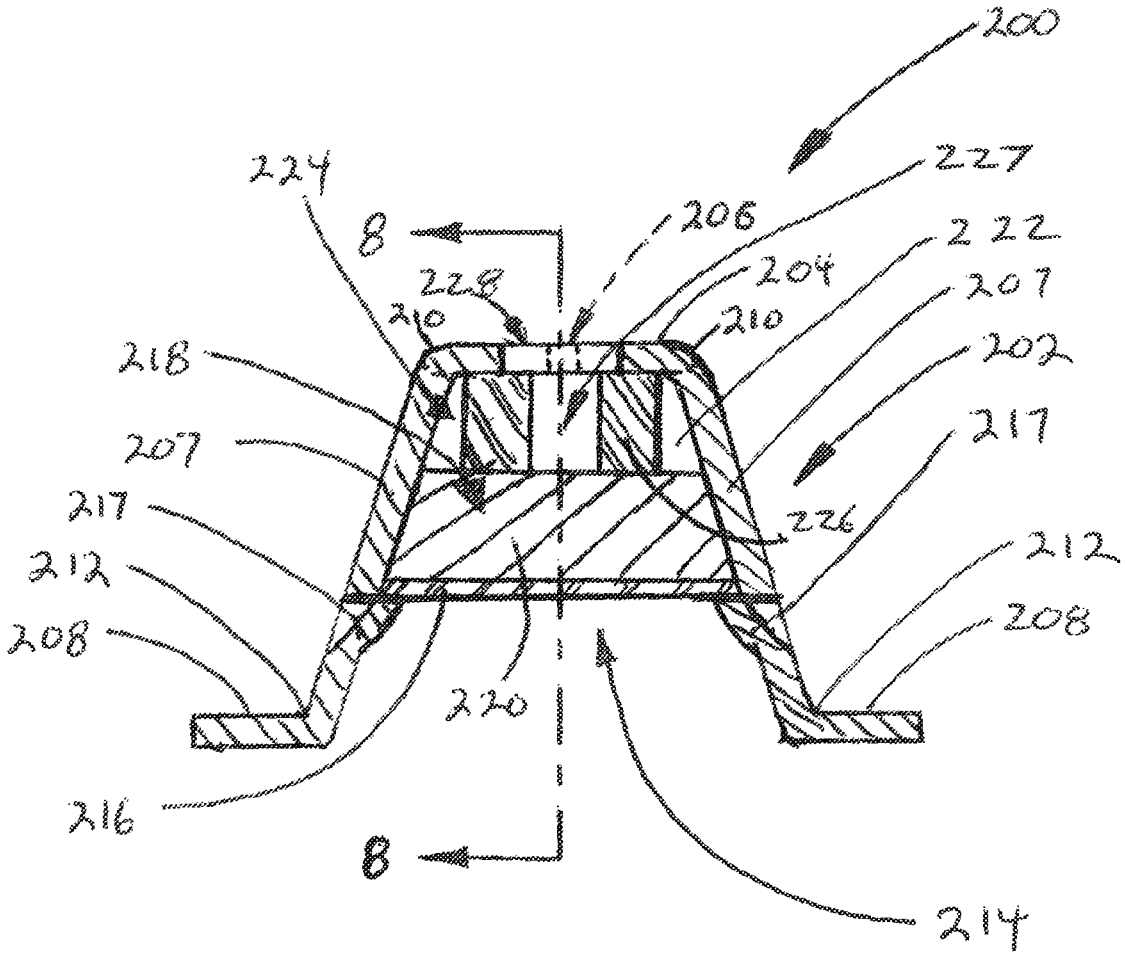
FIG. 9 is a sectional end view of the second embodiment of the concrete insert taken along line 9-9 of FIG. 8.
Figure 10:
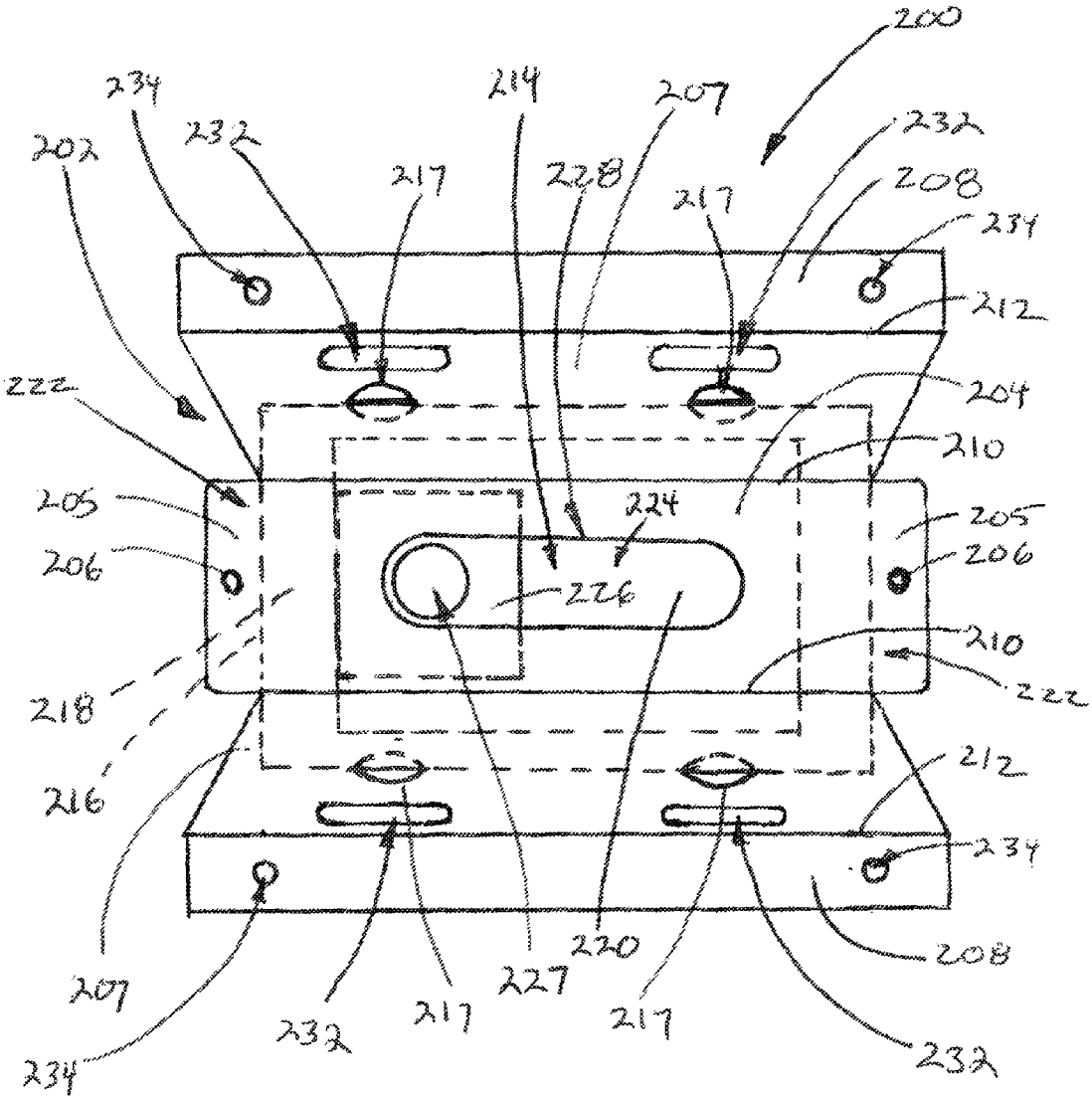
FIG. 10 is a top view of the second embodiment of the concrete insert.
Figure 11:
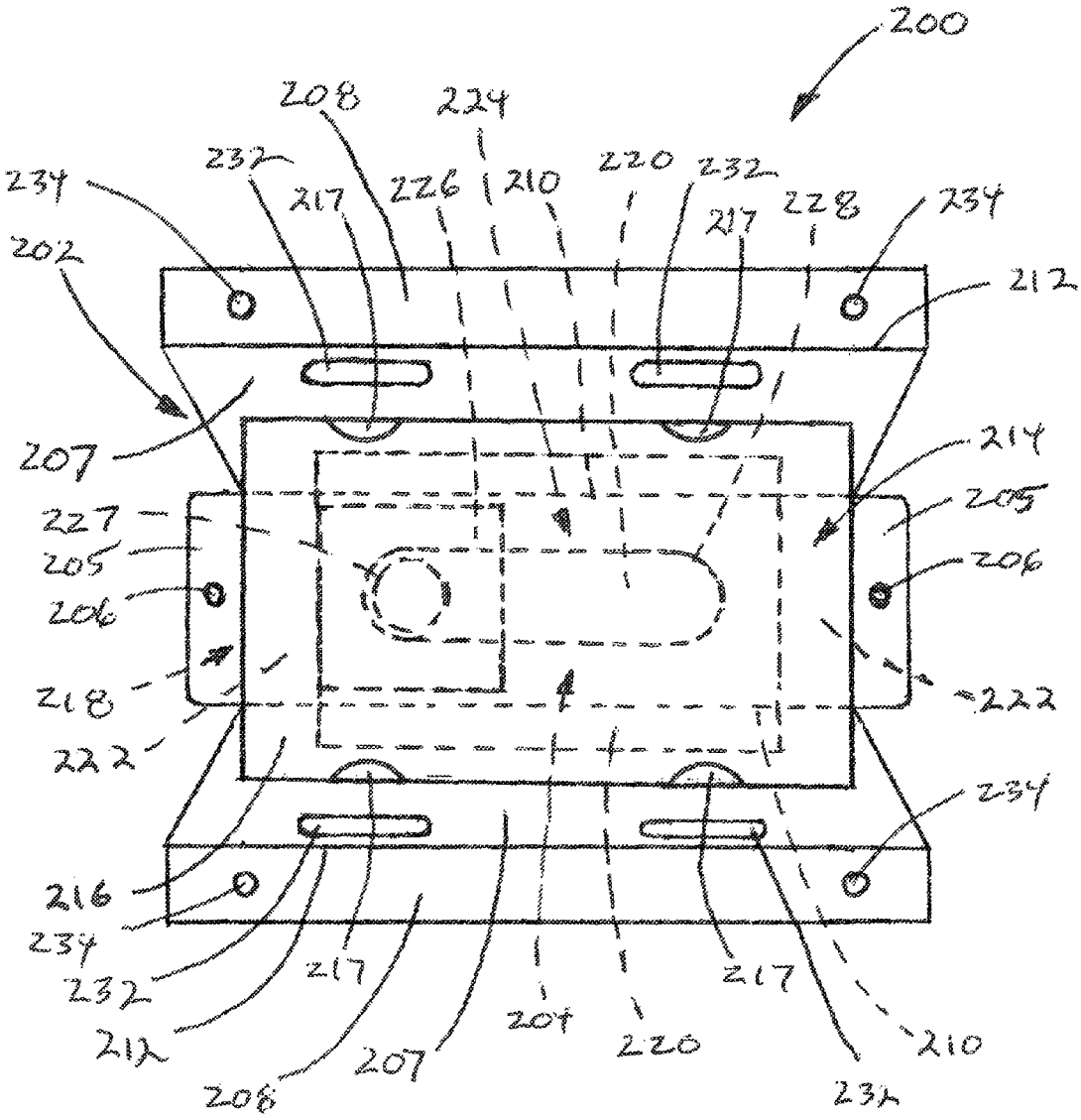
FIG. 11 is a bottom view of the second embodiment of the concrete insert.

FIG. 8 is a sectional side view of concrete insert 200 taken along line 8-8 of FIG. 9, and shows the same features as in FIG. 7. FIG. 9 is a sectional end view of concrete insert 200 and shows the same features as in FIG. 7. FIG. 10 is a top plan view of concrete insert 200 and shows the same features as in FIG. 7. FIG. 11 is a bottom plan view of concrete insert 200 and shows the same features as in FIG. 7.

Figure 12:
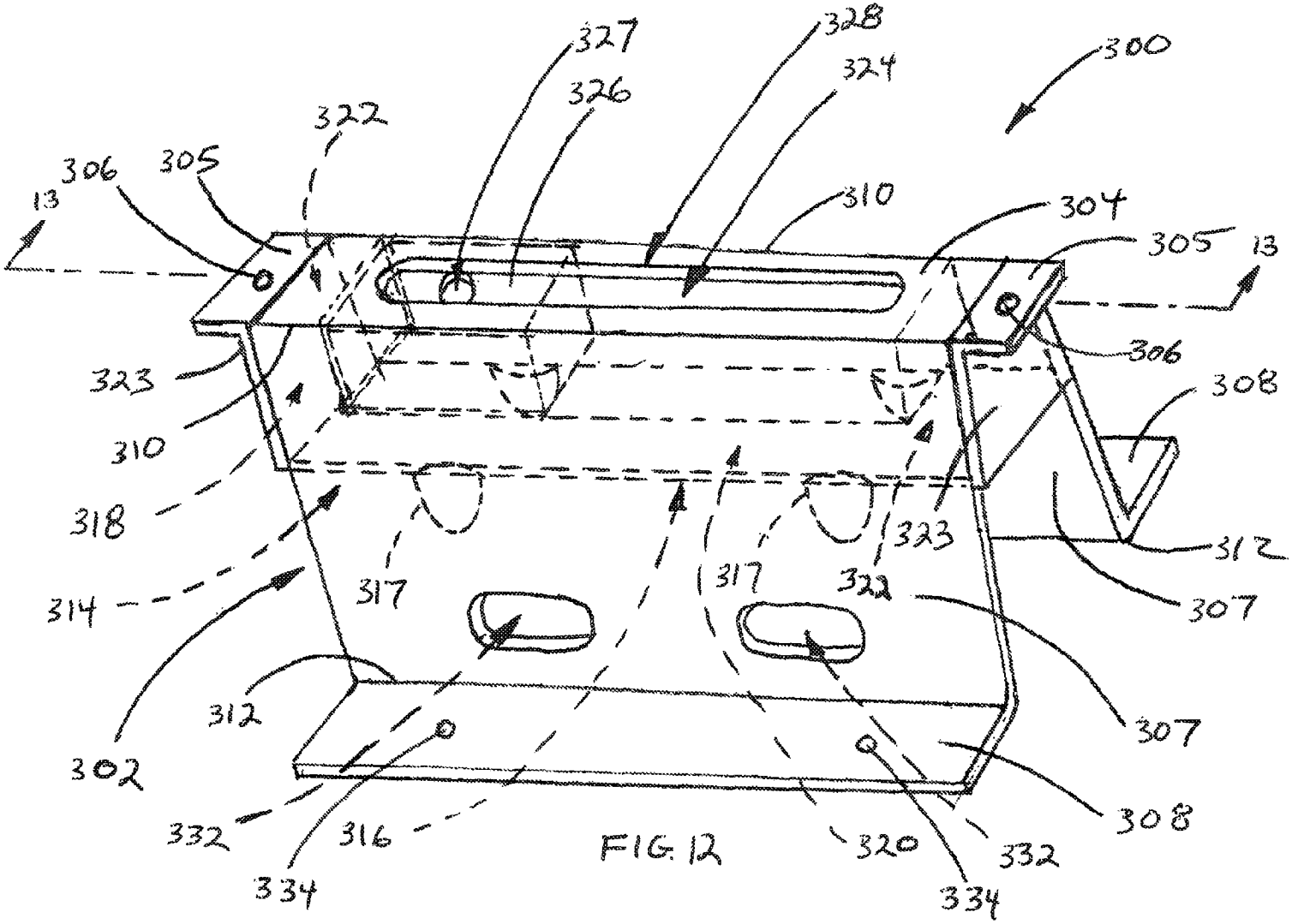
FIG. 12 is a perspective view of a third embodiment of the concrete insert.

FIG. 12 is a perspective view of a third embodiment of the concrete insert, namely, concrete insert 300. Concrete insert 300 has a housing 302 comprising a substantially flat elongate center portion. 304, having an outer attachment surface which is usually substantially flush with the mounting surface of the concrete wall panel in which concrete insert 300 is to be used.

Elongate center portion 304 is longitudinally bounded by substantially parallel outer longitudinal bend lines 310 and has a longitudinally oriented nut access slot 328 therebetween for the insertion of a threaded fastener, usually a bolt or threaded rod (not shown). Opposing longitudinal, sides 307 (of Housing 302) depend inwardly from outer longitudinal bend lines 110 (preferably in mutually divergent relation, although opposing longitudinal sides 307 may be parallel to each other for example), to inner longitudinal bend lines 312 (preferably parallel to outer longitudinal bend lines 310), and terminate at transverse opposing longitudinal flanges 308 depending from inner longitudinal bend lines 312 and extending in mutually divergent relation (preferably parallel to elongate center portion 304). Opposing longitudinal sides 307 are delineated from longitudinal flanges 308 by inner longitudinal bend lines 312. Longitudinal flanges 308 may be provided with stud apertures 334.

Compression plate 316 is attached between longitudinal sides 307 by compression plate supports 317 or other conventional means such as riveting, bolting, welding or the like. Attached to Compression plate 316 are opposing compression plate ends 323 for covering the open ends of housing 302 bounded by compression plate 316, opposing sides 307 and elongate center portion 304 between nut access slot 328 and mounting flanges 305 to prevent wet concrete from entering the nut box 324 during concrete panel forming. Attached to compression end plates 323 are opposing mounting flanges 305 each comprising mounting flange aperture 306 for mounting concrete insert 300 to a form. Mounting flanges 305 extend longitudinally from each end of elongate center portion 304, preferably, but not necessarily co-planer with elongate center portion 304.

Compression plate 316 carries on its inside surface a compression pad 318. Compression plate 316, compression plate ends, compression plate mounting flanges 305 and compression pad 318 together form nut box insert 314, located above rebar apertures 332. Compression pad 318 need not necessarily be made of foam rubber but can be made of any resilient layer or layers capable of biasing nut 326 against the inside surface of elongate center portion 304 for selectively locating and maintaining the threaded aperture 327 of nut 326 in a preselected position under nut access slot 328 for receiving a bolt, threaded rod or other threaded fastener, for attaching the concrete wall panel to a building, typically through an aperture in a fixed position in a structural member of a building, typically a steel girder.

A nut 326 is slideably mounted in nut box 324 on bottom portion 320 of compression pad 318, which in turn is carried by compression plate 316. The preferably square nut 326 is supported in sliding frictional engagement along the inside surface of bottom portion 320 of compression pad 318 and the inside surface of elongate center portion 304. Compression pad 318 may have has enlarged end portions 322 for sealing any gaps between compression plate ends 323 and housing 302 for preventing entry of wet cement into the nut box 324 during casting of concrete panels. Compression pad end portions 322 may also be sized to ensure that threaded aperture 327 of nut 326 is always under nut access slot 328. Nut 326 is readily longitudinally repositioned in nut box 324 by finger or other pressure. It is to be understood that preferably square nut 326 need not be square but may be in any shape to operably engage the inside surfaces of longitudinal sides 307 to constrain the nut 326 from turning in nut box 324 upon receiving a threaded fastener through nut access slot 328.

Compression pad 318 may comprise, one or more portions or sections, with each section or portion comprising one or more layers. For example bottom portion 320 and end portions 322, of compression pad 318 may be separate pieces, although it is preferable for bottom portion 320 and end portions 322 to be unitary. Alternatively, compression pad 318 may comprise layers of different materials, either separate or unitary. Bottom portion should be sufficiently resilient to hold nut 326 firmly in place while receiving a threaded fastener while still not making the positioning of nut 326 by hand difficult or impossible. Alternatively if strong positioning strength is required tools may be required to position nut 326. Further end portions 322 may be sized or contoured to best mate with the inside walls of longitudinal sides 307 and elongate center portion 104, when sufficiently compress to prevent the seepage of wet concrete into nut box 324. Porous foam is preferably not used even if significantly compressed due to the possibility of leaking. Foam rubber has been found to be particularly advantageous due to compression properties, both for biasing nut 326 and compressing end portions 322, as well as being substantially non-porous.

Alternatively, the mounting flanges 105 of concrete insert 100 may be used in concrete insert 300, in which case compression plate mounting flanges 305 (which would otherwise be attached to compression plate ends 323) would be omitted.

Figure 13:
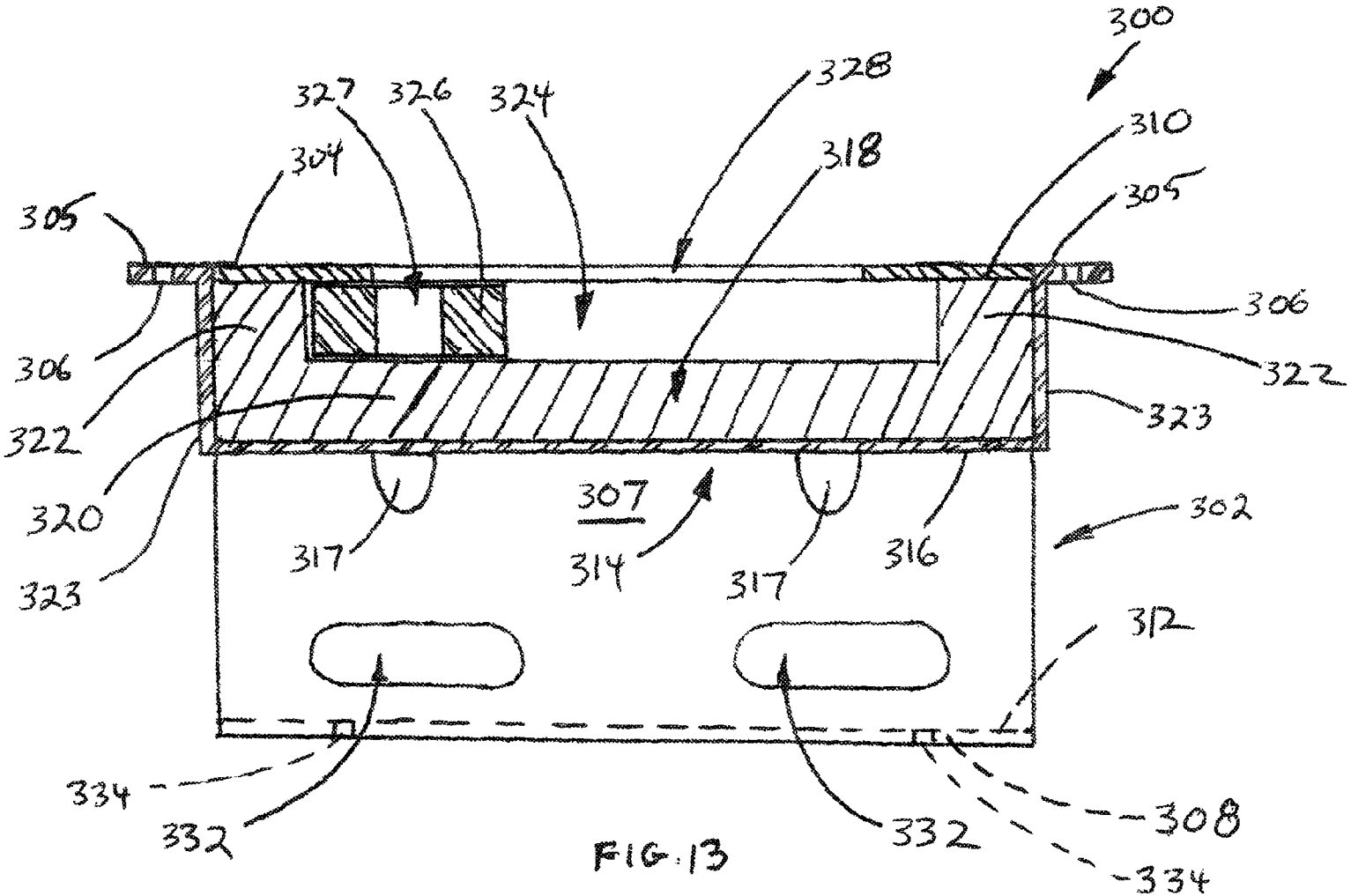
FIG. 13 is a sectional side view of the third embodiment of the concrete insert taken along line 13-13 of FIG. 12.

FIG. 13 is a sectional side view of concrete insert 300 taken along line 13-13 of FIG. 12, and shows the same features as in FIG. 12.

Figure 14:
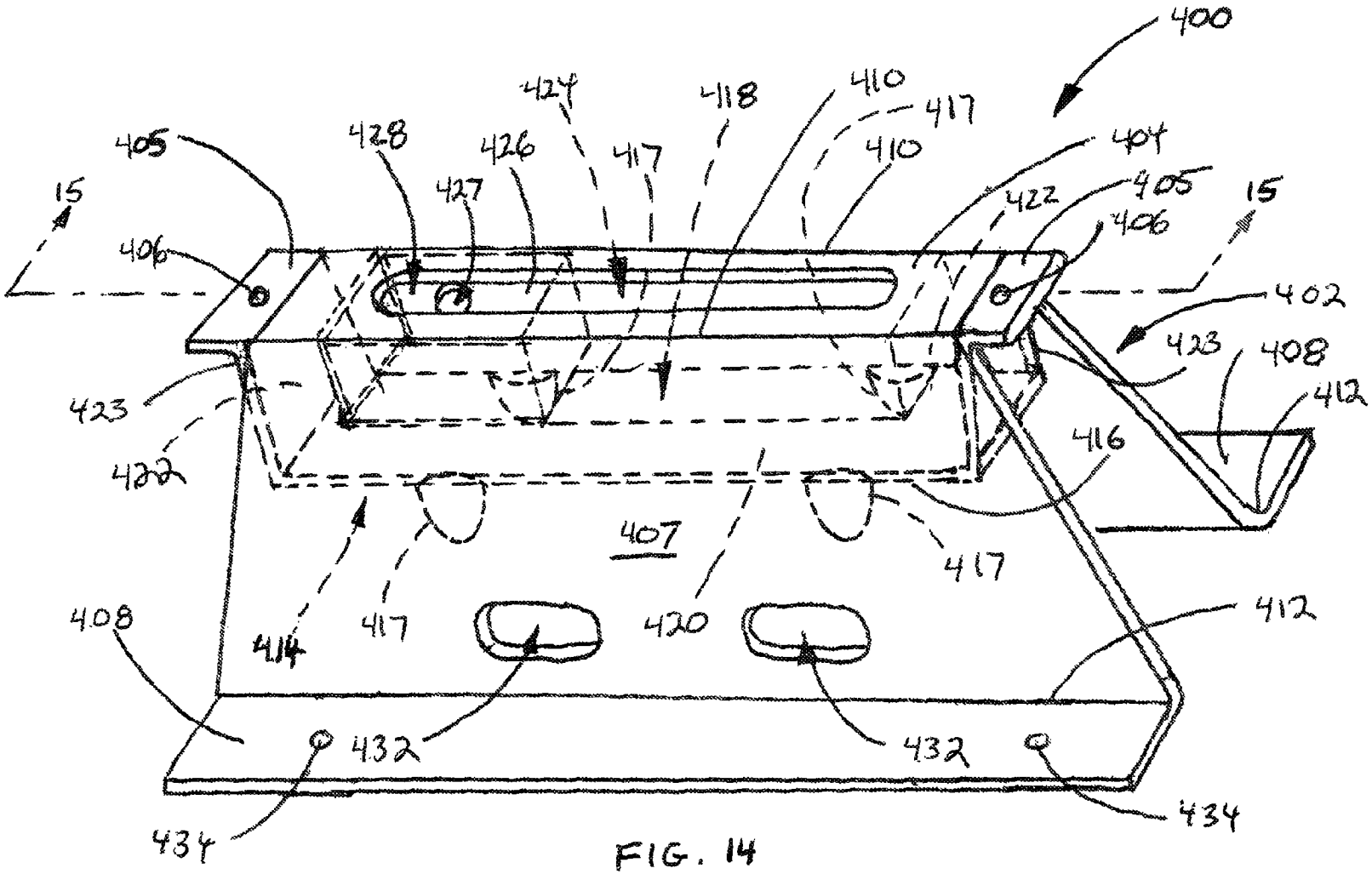
FIG. 14 is a perspective view of a fourth embodiment of the concrete insert.

FIG. 14 is a perspective view of a fourth embodiment of the concrete insert, namely, concrete insert 400. Concrete insert 400 is identical to concrete insert 300 except that concrete insert 400 shows the ends of longitudinal sides 407 extending inwardly from the ends of elongate center portion 404 in mutually divergent relation. Accordingly, compression plate 416 and end portions 422 of compression pad 418 need not extend longitudinally past the perpendicular extensions of the ends of elongate center portion 404 of FIG. 14 so that mounting flange apertures 406 of mounting flanges 405 are not blocked by compression plate 416 or end portions 422 of compression pad 418.

Elongate center portion 404 is longitudinally bounded by substantially parallel outer longitudinal bend lines 410 and has a longitudinally oriented, nut access slot 428 therebetween for the insertion of a threaded fastener, usually a bolt or threaded rod (not shown). Opposing longitudinal sides 407 (of Housing 402) depend inwardly from outer longitudinal bend lines 410 (preferably in mutually divergent relation, although opposing longitudinal sides 407 may be parallel to each other for example), to inner longitudinal bend lines 412 (preferably parallel to outer longitudinal bend lines 410), and terminate at transverse opposing longitudinal flanges 408 depending from inner longitudinal bend lines 412 and extending in mutually divergent relation (preferably parallel to elongate center portion 404). Opposing longitudinal sides 407 are delineated from longitudinal flanges 408 by inner longitudinal bend lines 412. Longitudinal flanges 408 may be provided with stud apertures 434.

Compression plate 416 is attached between longitudinal sides 407 by compression plate supports 417 or other conventional means such as riveting, bolting, welding or the like. Attached to Compression plate 16 are opposing compression plate ends 423 for covering the open ends of housing 402 bounded by compression plate 416, opposing sides 407 and elongate center portion 404 between nut access slot 428 and mounting flanges 405 to prevent wet concrete from entering the nut box 424 during concrete panel forming. Attached to compression end plates 423 are opposing mounting flanges 405 each, comprising mounting flange aperture 406, for mounting concrete insert 400 to a form. Mounting flanges 405 extend longitudinally from each end of elongate center portion 404, preferably, but not necessarily co-planer with elongate center portion 404.

Compression plate 416 carries on its inside surface a compression pad 418. Compression plate 416, compression plate ends, compression plate mounting flanges 405 and compression pad 418 together form nut box insert 414, located above rebar apertures 432. Compression pad 418 need not necessarily be made of foam rubber but can be made of any resilient layer or layers capable of biasing nut 426 against the inside surface of elongate center portion 404 for selectively locating and maintaining the threaded aperture 427 of nut 426 in a preselected position under nut access slot 428 for receiving a bolt, threaded rod or other threaded fastener, for attaching the concrete wall panel to a building, typically through an aperture in a fixed position in a structural member of a building, typically a steel girder.

A nut 426 is slideably mounted in nut box 424 on bottom portion 420 of compression pad 418, which in turn is carried by compression plate 416. The preferably square nut 426 is supported in sliding frictional engagement along the inside surface of bottom portion 420 of compression pad 418 and the inside surface of elongate center portion 404. Compression pad 418 may have has enlarged end portions 422 for sealing any gaps between compression plate ends 423 and housing 402 for preventing entry of wet cement into the nut box 424 during casting of concrete panels. Compression pad end portions 422 may also be sized to ensure that threaded aperture 427 of nut 426 is always under nut access slot 428. Nut 426 is readily longitudinally repositioned in nut box 424 by finger or other pressure. It is to be understood that preferably square nut 426 need not be square but may be in any shape to operably engage the inside surfaces of longitudinal sides 407 to constrain the nut 426 from turning in nut box 424 upon receiving a threaded fastener through nut access slot 428.

Compression pad 418 may comprise one or more portions or sections, with each section or portion comprising one or more layers. For example bottom portion 420 and end portions 422, of compression pad 418 may be separate pieces, although it is preferable for bottom portion 420 and end portions 422 to be unitary. Alternatively, compression pad 418 may comprise layers of different materials, either separate or unitary. Bottom portion should be sufficiently resilient to hold nut 426 firmly in place while receiving a threaded fastener while still not making the positioning of nut 426 by hand difficult or impossible. Alternatively if strong positioning strength is required tools may be required to position nut 426. Further end portions 422 may be sized or contoured to best mate with the inside walls of longitudinal sides 407 and elongate center portion 404, when sufficiently compressed to prevent the seepage of wet concrete into nut box 424. Porous foam is preferably not used even if significantly compressed due to the possibility of leaking. Foam rubber has been found to be particularly advantageous due to compression properties, both for biasing nut 426 and compressing end portions 422, as well as being substantially non-porous.

Alternatively, the mounting flanges 105 of concrete insert 100 may be used in concrete insert 400, in which case compression plate mounting flanges 405 (which would otherwise be attached to compression plate ends 423) would be omitted.

Figure 15:
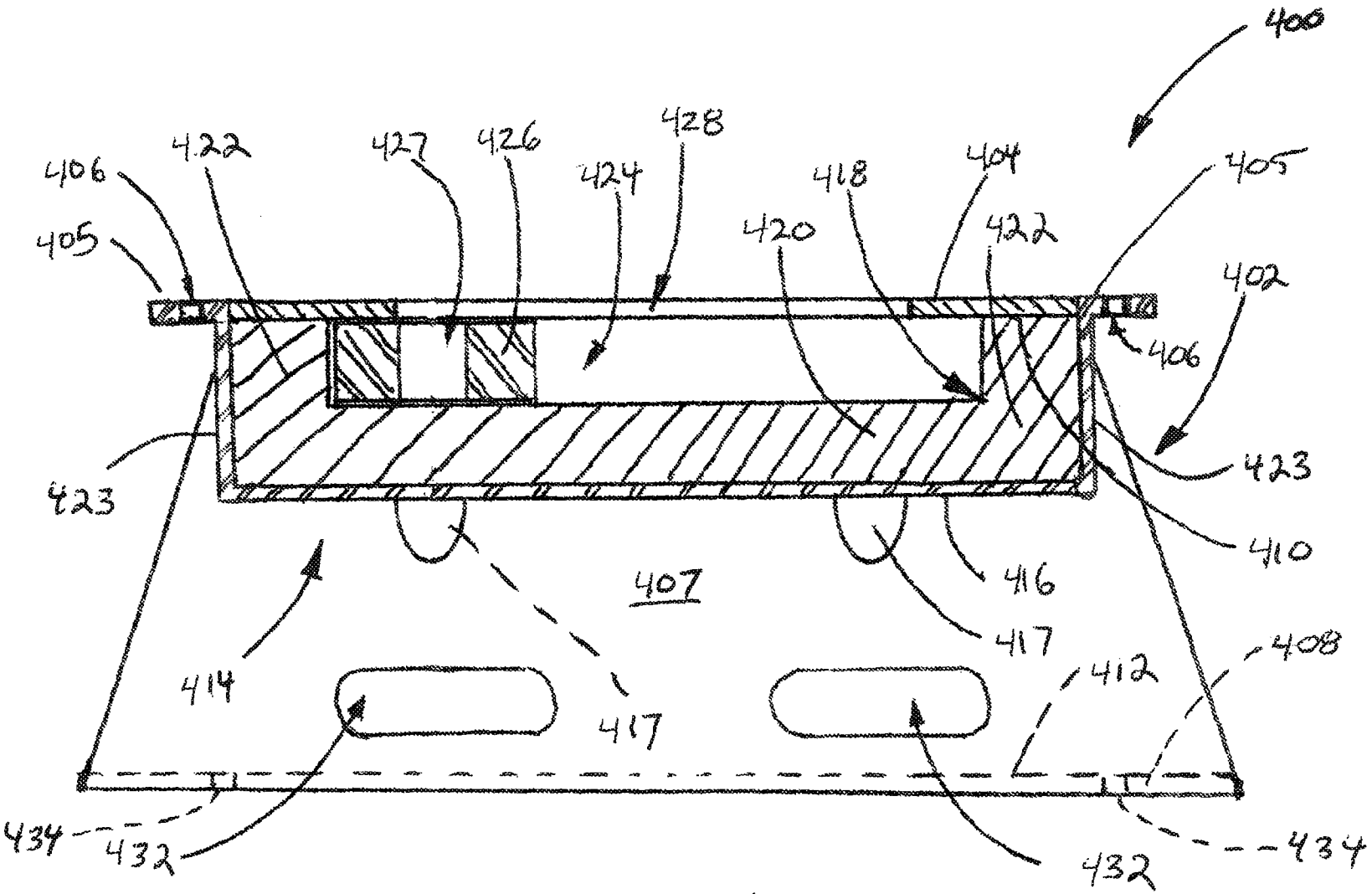
FIG. 15 is a sectional side view of the fourth embodiment of the concrete insert taken along line 15-15 of FIG. 14.

FIG. 15 is a sectional side view of concrete insert 400 taken along line 15-15 of FIG. 14, and shows the same features as in FIG. 14.

The above embodiments are to be understood as examples and not as limiting the scope of the invention.

PARTS LIST

20 PRIOR ART CONCRETE INSERT
22 HOUSING
24 ELONGATE CENTER PORTION
26 LONGITUDINAL SIDES OF HOUSING
28 LONGITUDINAL FLANGES
30 OUTER LONGITUDINAL BEND LINES
32 INNER LONGITUDINAL BEND LINES
34 PRIOR ART PLASTIC NUT BOX INSERT
36 BOTTOM OF NUT BOX INSERT
38 NUT BOX INSERT ENDS
40 NUT BOX INSERT FLANGES
42 MOUNTING APERTURES (IN NUT BOX INSERT FLANGES)
44 PUNCHED NUT BOX INSERT SUPPORTS
46 NUT BOX
48 NUT ACCESS SLOT
50 NUT (WITH SPRING RECESS)
52 THREADED APERTURE (OF NUT)
54 RECESSED SEAT (OF NUT)
56 BIASING SPRING
58 NUT ACCESS SLOT CAP
60 REBAR APERTURES
62 STUD APERTURES
100 FIRST EMBODIMENT OF CONCRETE INSERT
102 HOUSING,
104 ELONGATE CENTER PORTION
105 MOUNTING FLANGES
106 MOUNTING FLANGE APPERTURES
107 LONGITUDINAL SIDES OF HOUSING
108 LONGITUDINAL FLANGES
110 OUTER LONGITUDINAL BEND LINES
112 INNER LONGITUDINAL BEND LINES
114 COMPOUND NUT BOX INSERT
116 COMPRESSION PLATE
117 COMPRESSION PLATE SUPPORTS
118 COMPRESSION PAD
120 BOTTOM PORTION (OF COMPRESSION PAD)
122 END PORTIONS (OF COMPRESSION PAD)
124 NUT BOX
126 NUT
127 THREADED APERTURE (OF NUT)
128 NUT ACCESS SLOT
132 REBAR APERTURES
134 STUD APERTURES
200 SECOND EMBODIMENT OF CONCRETE INSERT
202 HOUSING
204 ELONGATE CENTER PORTION
205 MOUNTING FLANGES
206 MOUNTING FLANGE APPERTURES
207 LONGITUDINAL SIDES OF HOUSING
208 LONGITUDINAL FLANGES
210 OUTER LONGITUDINAL BEND LINES
212 INNER LONGITUDINAL BEND LINES
214 COMPOUND NUT BOX INSERT
216 COMPRESSION PLATE
217 COMPRESSION PLATE SUPPORTS
218 COMPRESSION PAD
220 BOTTOM PORTION (OF COMPRESSION PAD)
222 END PORTIONS (OF COMPRESSION PAD)
224 NUT BOX
226 NUT
227 THREADED APERTURE (OF NUT)
228 NUT ACCESS SLOT
232 REBAR APERTURES
234 STUD APERTURES
300 THIRD EMBODIMENT OF CONCRETE INSERT
302 HOUSING
304 ELONGATE CENTER PORTION
305 COMPRESSION PLATE MOUNTING FLANGES

306 COMPRESSION PLATE MOUNTING FLANGE APPERTURES
307 LONGITUDINAL SIDES OF HOUSING
308 LONGITUDINAL FLANGES
310 OUTER LONGITUDINAL BEND LINES
312 INNER LONGITUDINAL BEND LINES
314 COMPOUND NUT BOX INSERT
316 COMPRESSION PLATE
317 COMPRESSION PLATE SUPPORTS
318 COMPRESSION PAD
320 BOTTOM PORTION (OF COMPRESSION PAD)
322 END PORTIONS (OF COMPRESSION PAD)
323 COMPRESSION PLATE ENDS
324 NUT BOX
326 NUT
327 THREADED APERTURE (OF NUT)
328 NUT ACCESS SLOT
332 REBAR APERTURES
334 STUD APERTURES
400 FOURTH EMBODIMENT OF CONCRETE INSERT
402 HOUSING
404 ELONGATE CENTER PORTION
405 COMPRESSION PLATE MOUNTING FLANGES
406 COMPRESSION PLATE MOUNTING FLANGE APPERTURES
407 LONGITUDINAL SIDES OF HOUSING
408 LONGITUDINAL FLANGES
410 OUTER LONGITUDINAL BEND LINES
412 INNER LONGITUDINAL BEND LINES
414 COMPOUND NUT BOX INSERT
416 COMPRESSION PLATE
417 COMPRESSION PLATE SUPPORTS
418 COMPRESSION PAD
420 BOTTOM PORTION (OF COMPRESSION PAD)
422 END PORTIONS (OF COMPRESSION PAD)
423 COMPRESSION PLATE ENDS
424 NUT BOX
426 NUT
427 THREADED APERTURE (OF NUT)
428 NUT ACCESS SLOT
432 REBAR APERTURES
434 STUD APERTURES

I claim:

1. A concrete insert for casting in a. concrete wall panel, the concrete wall panel having an inside surface for attachment to a building, comprising:

a housing having an elongate center portion and two opposing longitudinal sides, and two opposing longitudinal flanges;

the elongate center portion, bounded by opposing outer longitudinal bend lines and having an outer attachment surface for mounting the elongate center portion substantially flush with the inside surface of the concrete wall panel, the elongate center portion defining a longitudinally oriented nut access slot;

the opposing longitudinal sides depending inwardly from the opposing outer longitudinal bend lines to opposing inner longitudinal bend lines;

the opposing longitudinal flanges depending from opposing inner longitudinal bend lines transversely to the opposing longitudinal sides and extending in mutually divergent relation;

the housing further having a nut box insert comprising a nut box;

a nut defining a threaded aperture, the nut slidably mounted in the nut box, the housing for constraining rotation of the nut for the threaded aperture in the nut to receive a threaded fastener through the nut access slot for attaching the concrete wall panel to the building;

the nut box insert comprising at least one resilient layer carried by a compression plate, the compression plate attached to the housing, the compression plate for compressing the at least one resilient layer against the bottom of the nut for permitting the nut to be slidably located within the nut box and for holding the nut under pressure in a selected location in the nut box for the threaded aperture in the nut to receive the threaded fastener through the nut access slot while the nut is in the selected location.

2. The concrete insert of claim 1 wherein the resilient layer comprises resilient end walls compressed against the housing by the compression plate for substantially preventing wet cement from entering the nut box during casting of the concrete panel.

3. The concrete insert of claim 2 wherein the compression plate compresses the at least one resilient layer against the longitudinal sides of the housing to seal the bottom of the housing and against the sides and elongate center portion to seal the ends of the housing.

4. The concrete insert claim 2 wherein the ends of the at least one resilient layer is sized to contour to the shape of the ends of the housing when compressed by the compression plate.

5. The concrete insert of claim 3 wherein each end of the at least one resilient layer is compressed against the elongate center portion between an end of the housing and the nut access slot.

6. The concrete insert of claim 2 wherein the threaded aperture of the nut is positioned under an end of the nut access slot when the nut abuts an end of the at least one resilient layer.

7. The concrete insert of claim 2 wherein the ends of the longitudinal sides of the housing are substantially perpendicular to the elongate center portion of the housing.

8. The concrete insert of claim 2 wherein the ends of the longitudinal sides of the housing extend outwardly from the elongate center portion in mutually divergent relation.

9. The concrete insert of claim 2 wherein the elongate center portion includes end flanges for attaching the concrete insert to a form for casting the concrete wall panel.

10. The concrete insert of claim 9 wherein the end flanges are adapted to break off when the concrete panel is removed from the form.

11. The concrete insert of claim 2 wherein the resilient layer is unitary.

12. The concrete insert of claim 2 wherein at least one of the resilient ends of the at least one resilient layer are separate from the resilient layer.

13. The concrete insert of claim 2 wherein the resilient layer comprises foam rubber.

14. The concrete insert of claim 2 wherein the at least one resilient layer comprises one layer.

15. The concrete insert of claim 1 wherein the compression plate comprises end walls for substantially preventing wet cement from entering the nut box during casting of the concrete panel.

16. The concrete insert of claim 15 wherein the compression plate end walls are substantially rigid.

17. The concrete insert of claim 15 wherein the compression plate end walls seal the end of the housing.

18. The concrete insert of claim 15 wherein the compression plate seals the bottom and ends of the housing.

19. The concrete insert of claim 15 wherein the compression plate end walls comprise flanges for attaching the concrete insert to the form.

20. The concrete insert of claim 15 wherein the flanges are adapted to break off when the concrete panel is removed from the form.

21. The concrete insert of 15 wherein the compression plate is made of plastic.

22. The concrete insert of 15 wherein the compression plate is made of metal.

23. The concrete insert of claim 15 wherein the compression plate carries one or more resilient layers for sealing any gaps between the compression plate and the housing.

24. The concrete insert of claim 15 wherein the compression plate carries one or more resilient layer comprising resilient end walls compressed against the housing by the compression plate for sealing gaps between the compression plate and the housing.

25. The concrete insert of claim 1 wherein the compression plate is attached to the longitudinal sides of the housing.

* * * * *